US010468825B2

(12) United States Patent
Zhao et al.

(10) Patent No.: US 10,468,825 B2
(45) Date of Patent: Nov. 5, 2019

(54) ELECTRICAL CONNECTOR FREE FROM MELTING OF PLASTICS AT HIGH TEMPERATURES WHILE SHIELDING HIGH FREQUENCY INTERFERENCE

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/100,192

(22) Filed: Aug. 9, 2018

(65) Prior Publication Data

US 2019/0052024 A1 Feb. 14, 2019

(30) Foreign Application Priority Data

Aug. 10, 2017 (CN) ..... 2017 1 0680733

(51) Int. Cl.

| | |
|---|---|
| ***H01R 13/6585*** | (2011.01) |
| ***H01R 13/6597*** | (2011.01) |
| ***H01R 12/72*** | (2011.01) |
| ***H01R 13/504*** | (2006.01) |
| ***H01R 13/6461*** | (2011.01) |

(Continued)

(52) U.S. Cl.

CPC ..... *H01R 13/6585* (2013.01); *H01R 12/725* (2013.01); *H01R 13/405* (2013.01); *H01R 13/46* (2013.01); *H01R 13/504* (2013.01); *H01R 13/6461* (2013.01); *H01R 13/6597* (2013.01); *H01R 13/533* (2013.01); *H01R 13/6599* (2013.01); *H01R 24/60* (2013.01)

(58) Field of Classification Search

CPC ..... H01R 13/533; H01R 13/46; H01R 13/40; H01R 13/50; H01R 13/502; H01R 13/6581; H01R 13/6583; H01R 13/6585; H01R 13/6586; H01R 13/6599

USPC ..... 439/607.02

See application file for complete search history.

(56) References Cited

U.S. PATENT DOCUMENTS 6,551,658 B1 * 4/2003 Clough ..... C23C 8/02 427/212
9,225,130 B2 * 12/2015 Zhang ..... H01R 13/405

(Continued)

FOREIGN PATENT DOCUMENTS

CN 205178176 4/2016
CN 106129688 A 11/2016

(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes: a contact module having a base portion, a tongue portion extending forwardly from the base portion, and two rows of conductive terminals, the tongue portion including a front mating portion and a rear thickened portion, each conductive terminal including a contacting portion exposed to two surfaces of the front mating portion and a soldering portion extending outwardly from the base portion, wherein the contact module is constructed of a ceramic flat portion and an insulator.

18 Claims, 15 Drawing Sheets

(51) Int. Cl.

| | |
|---|---|
| ***H01R 13/405*** | (2006.01) |
| ***H01R 13/46*** | (2006.01) |
| *H01R 13/533* | (2006.01) |
| *H01R 13/6599* | (2011.01) |
| *H01R 24/60* | (2011.01) |

(56) References Cited

U.S. PATENT DOCUMENTS

| | | | | |
|---|---|---|---|---|
| 9,450,355 | B2 * | 9/2016 | Zhang | H01R 24/60 |
| 9,478,915 | B2 * | 10/2016 | Guo | H01R 13/6585 |
| 9,484,662 | B2 * | 11/2016 | Guo | H01R 13/504 |
| 9,484,679 | B2 * | 11/2016 | Guo | H01R 13/6585 |
| 9,496,664 | B2 * | 11/2016 | Little | H01R 13/6587 |
| 9,525,244 | B1 * | 12/2016 | Hsu | H01R 13/6585 |
| 9,685,728 | B2 * | 6/2017 | Yao | H01R 13/521 |
| 9,722,360 | B2 * | 8/2017 | Yao | H01R 13/652 |
| 9,954,317 | B2 * | 4/2018 | Zhao | H01R 12/58 |
| 2015/0111433 | A1 * | 4/2015 | Hou | H01R 12/707 439/626 |
| 2015/0194770 | A1 * | 7/2015 | Little | H01R 13/6582 439/607.27 |
| 2015/0200504 | A1 * | 7/2015 | Little | H01R 24/60 439/607.55 |
| 2015/0222059 | A1 * | 8/2015 | Little | H01R 13/6587 439/607.55 |
| 2015/0229077 | A1 * | 8/2015 | Little | H01R 12/724 439/78 |
| 2015/0244111 | A1 * | 8/2015 | Ju | H01R 13/6585 439/607.05 |
| 2015/0255905 | A1 * | 9/2015 | Little | H01R 13/6658 439/78 |
| 2015/0295356 | A1 * | 10/2015 | Tziviskos | H01R 24/64 439/248 |
| 2015/0295362 | A1 * | 10/2015 | Tziviskos | H01R 13/6581 439/607.01 |
| 2016/0064869 | A1 * | 3/2016 | Yu | H01R 24/60 439/607.05 |
| 2016/0118752 | A1 * | 4/2016 | Guo | H01R 13/6585 439/78 |
| 2016/0141806 | A1 * | 5/2016 | Guo | H01R 13/504 439/607.01 |
| 2016/0294102 | A1 * | 10/2016 | Zhao | H01R 13/6581 |
| 2016/0294105 | A1 * | 10/2016 | Zhao | H01R 13/5202 |
| 2017/0033519 | A1 * | 2/2017 | Little | H01R 24/60 |
| 2017/0047693 | A1 * | 2/2017 | Little | H01R 13/6587 |
| 2017/0141495 | A1 * | 5/2017 | Cheng | H01R 12/712 |
| 2017/0155216 | A1 * | 6/2017 | Yao | H01R 12/722 |
| 2017/0201048 | A1 * | 7/2017 | Kong | H01R 13/6594 |

FOREIGN PATENT DOCUMENTS

| | | | |
|---|---|---|---|
| CN | 106159522 | A | 11/2016 |
| CN | 106252960 | A | 12/2016 |

* cited by examiner

ELECTRICAL CONNECTOR FREE FROM MELTING OF PLASTICS AT HIGH TEMPERATURES WHILE SHIELDING HIGH FREQUENCY INTERFERENCE

BACKGROUND OF THE DISCLOSURE

1. Field of the Disclosure

The present disclosure relates to an electrical connector, and more particularly to an electrical connector capable of preventing melting of plastic at high temperatures and shielding high frequency interference.

2. Description of Related Arts

China Patent No. 205178176 discloses an electrical connector including an insulative housing and a contact module assembled to the insulative housing. The contact module includes an upper contact module, a lower contact module, and a metal shielding plate sandwiched between the upper contact module and the lower contact module. The upper contact module includes an upper insulator and a number of upper terminals affixed to the upper insulator. The lower contact module includes a lower insulator and a number of lower terminals affixed to the lower insulator. The upper insulator, the lower insulator, and the metal shielding plate are integrated with each other by assembling. The upper insulator and the lower insulator are injection molded from plastic materials. The electrical connector is used for conveying high current and may cause safety hazards due to melting of the upper insulator and the lower insulator.

To solve the problem, China Patent No. 106129688 discloses an electrical connector replacing the insulative materials by ceramic materials. Due to the high sintering temperature of the ceramic, the risk of melting the plastic when the conductive terminal is at high temperature high is avoided. However the electrical connector could not shield high frequency signal interference in transmitting high frequency signals.

An improved electrical connector is desired.

SUMMARY OF THE DISCLOSURE

Accordingly, an object of the present disclosure is to provide an electrical connector free from melting of plastics at high temperatures while shielding high frequency interference.

To achieve the above object, an electrical connector comprises: a contact module comprising a base portion, a tongue portion extending forwardly from the base portion, and two rows of conductive terminals, the tongue portion including a front mating portion and a rear thickened portion, each conductive terminal including a contacting portion exposed to two surfaces of the front mating portion and a soldering portion extending outwardly from the base portion; wherein the contact module is constructed of a ceramic flat portion and an insulator. The electrical connector replaces the tongue portion affixing with the conductive terminals from insulative materials to ceramic materials, thereby preventing the shortcoming of the plastic being easily melted at a high temperature caused by a large temperature increase during use and protecting the safety of the electrical connector.

Other objects, advantages and novel features of the disclosure will become more apparent from the following detailed description when taken in conjunction with the accompanying drawings.

DETAILED DESCRIPTION OF THE PREFERRED EMBODIMENT

Figure 7:
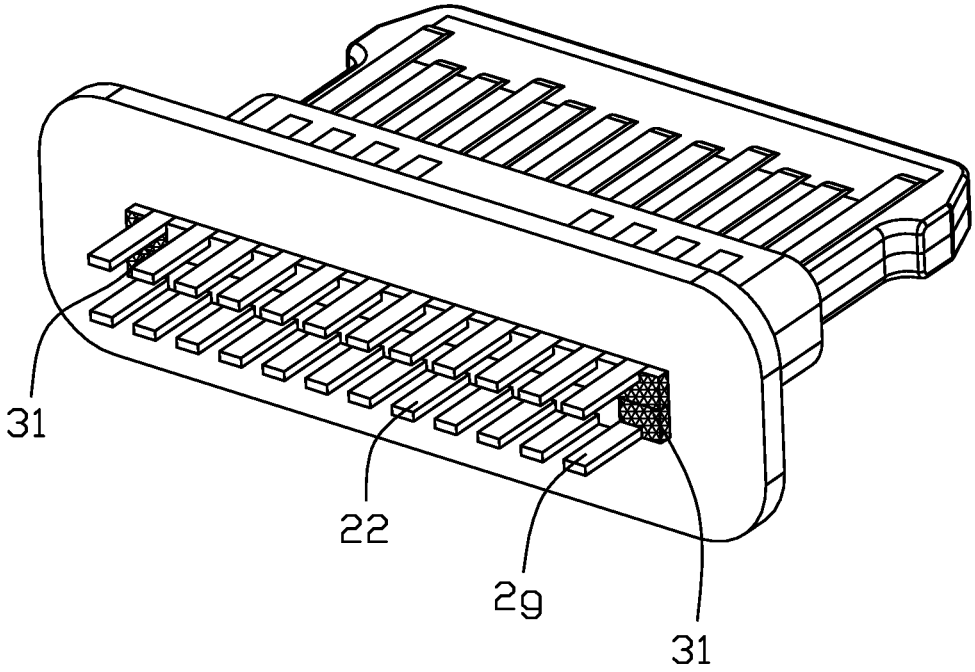
FIG. 7 is a perspective, assembled view of the contact module in a second embodiment.
Figure 8:
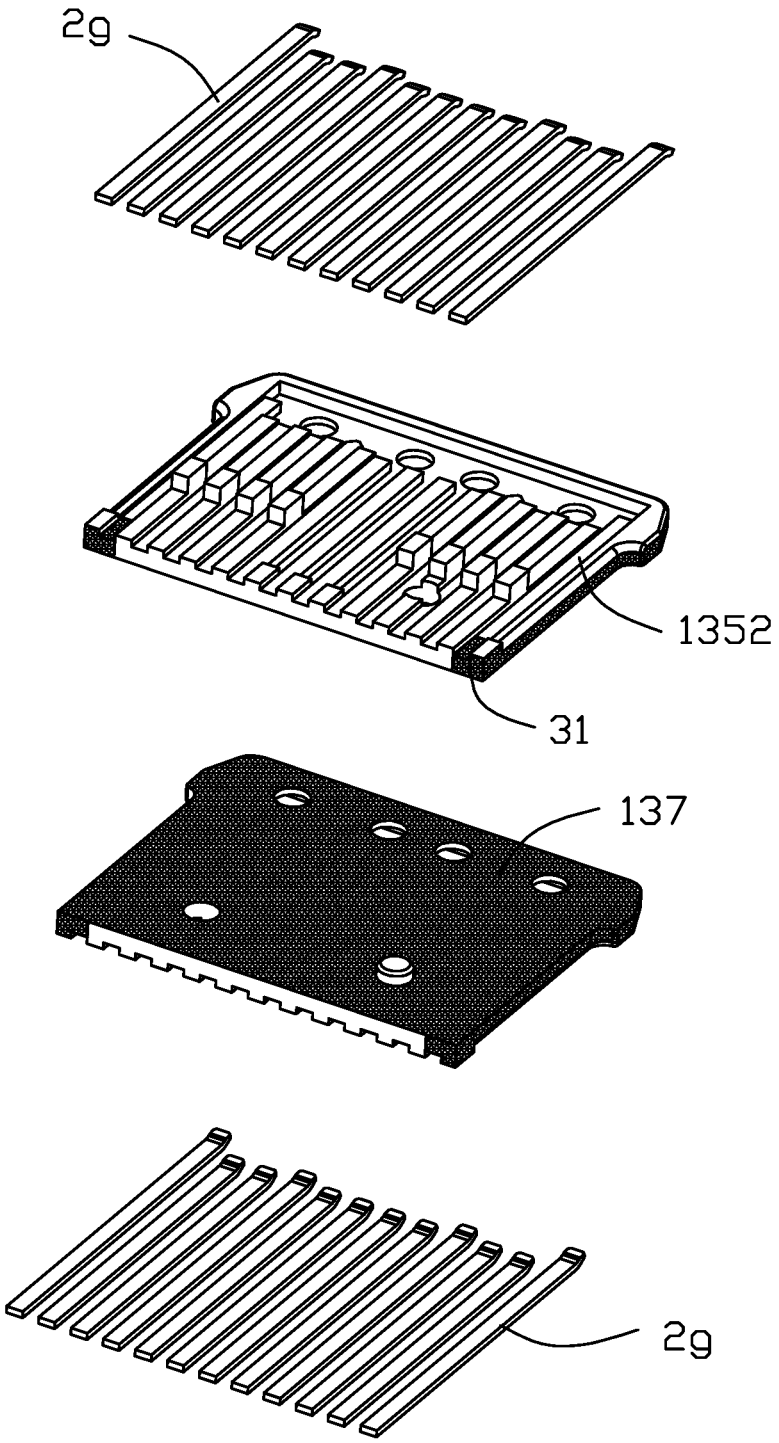
FIG. 8 is an exploded view of the ceramic flat portion and the conductive terminals of the electrical connector in the second embodiment.
Figure 9:
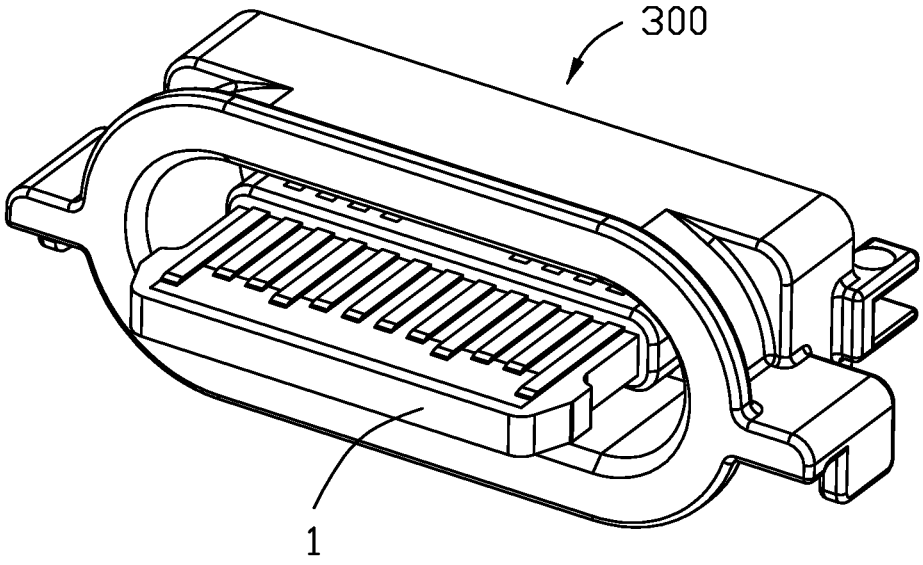
FIG. 9 is a perspective, assembled view of the electrical connector in a third embodiment.
Figure 10:
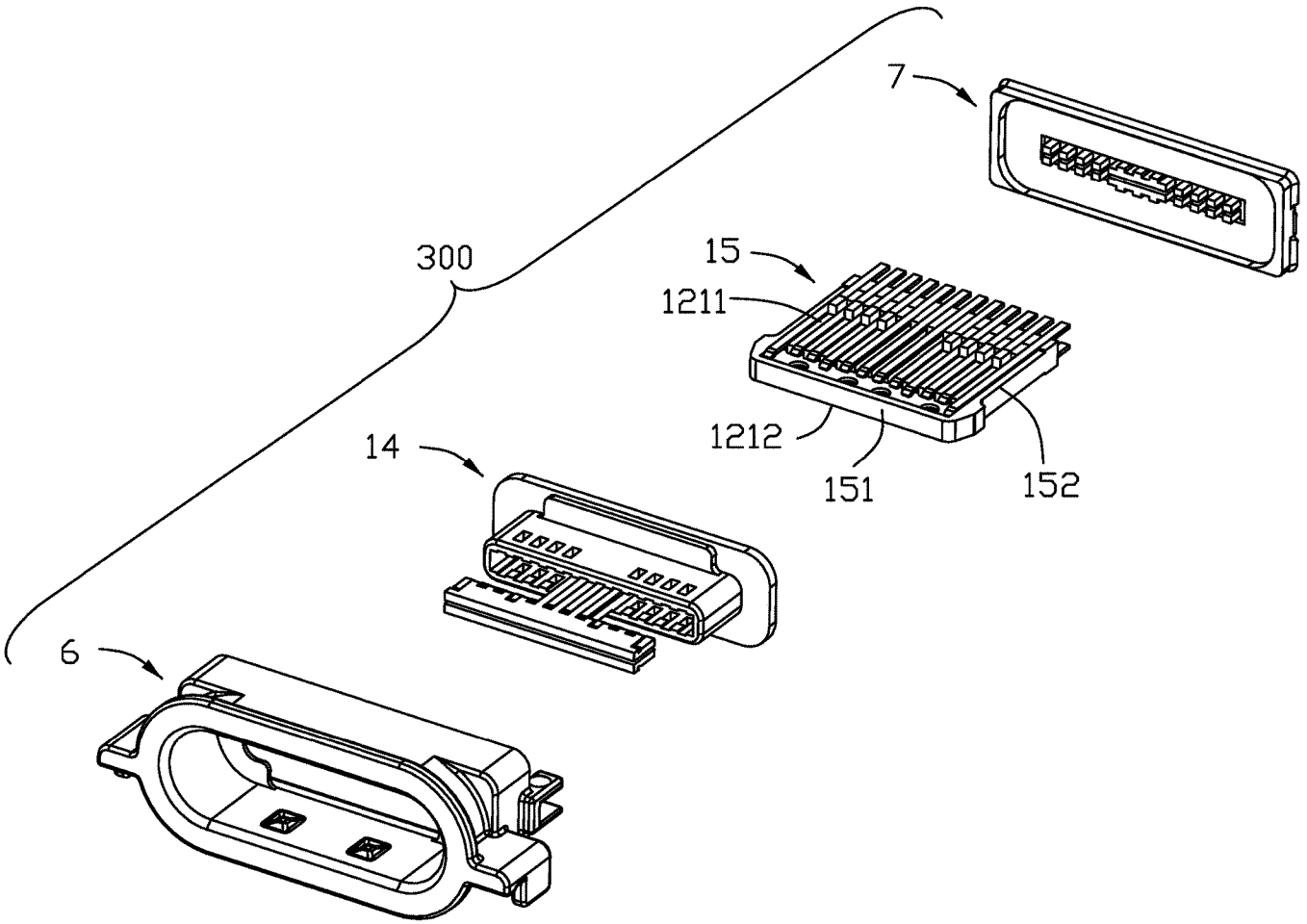
FIG. 10 is an exploded view of the electrical connector in the third embodiment.
Figure 11:
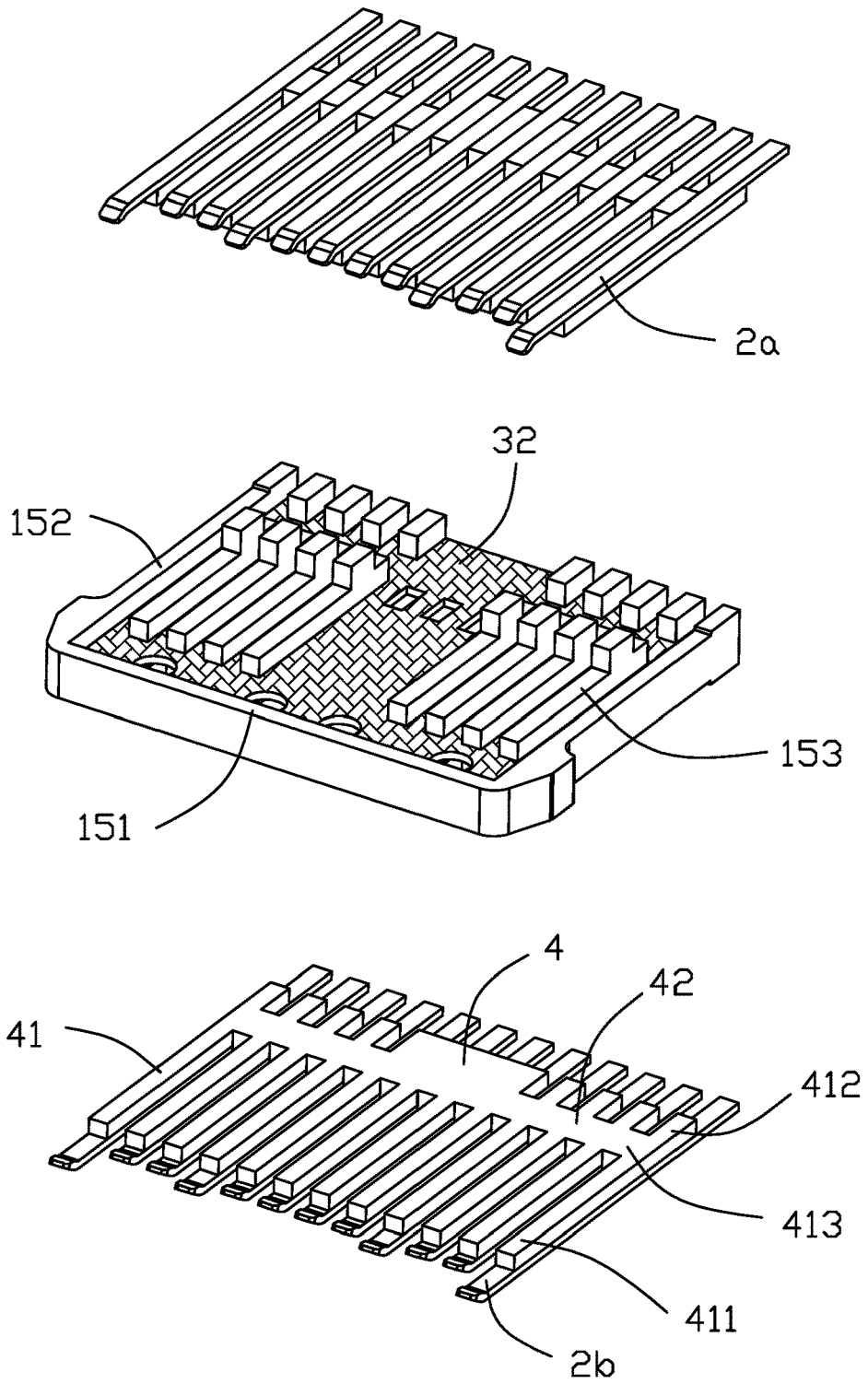
FIG. 11 is an exploded view of the ceramic flat portion and the conductive terminals of the electrical connector in the third embodiment.
Figure 12:
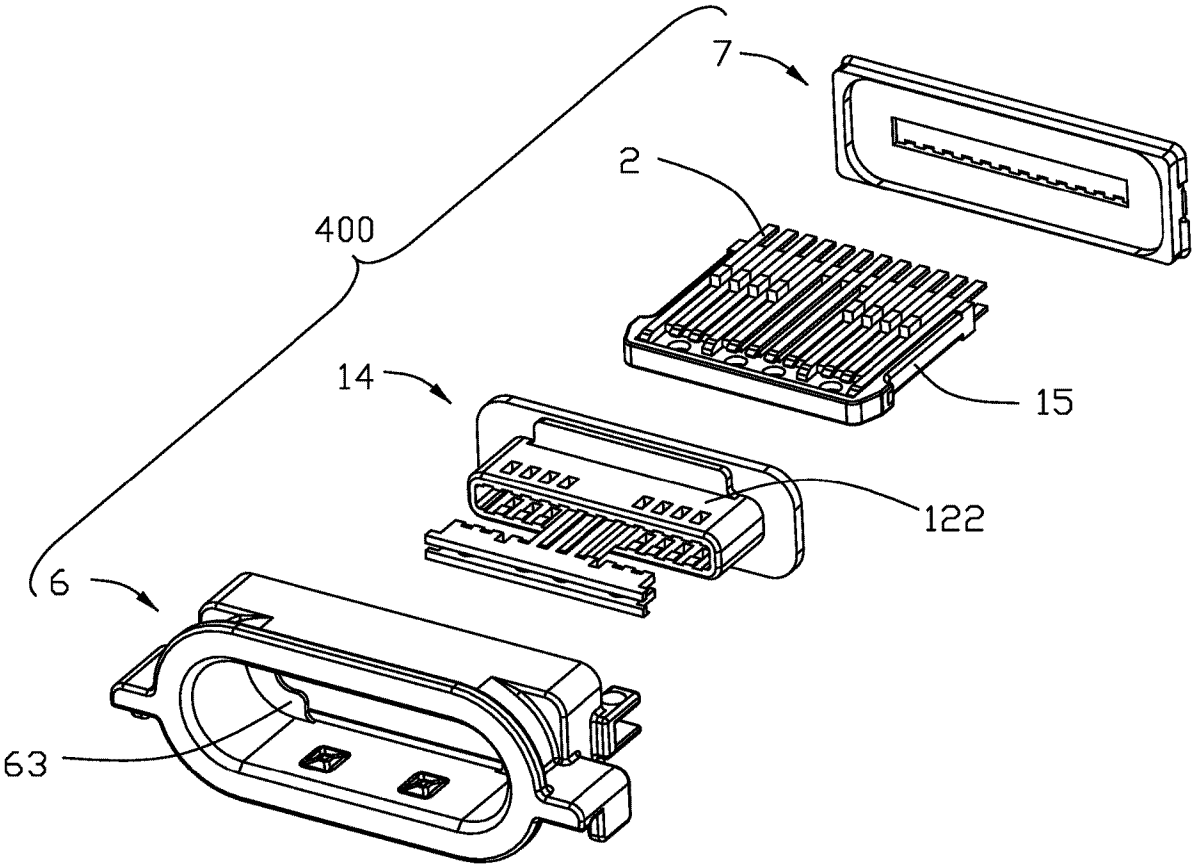
FIG. 12 is an exploded view of the electrical connector in a fourth embodiment.

Reference will now be made in detail to the embodiments of the present disclosure. A first embodiment is shown in FIGS. 1 to 6. A second embodiment is shown in FIGS. 7 to 8. A third embodiment is shown in FIGS. 9 to 11. A fourth embodiment is shown in FIGS. 12 to 15.

Figure 1:
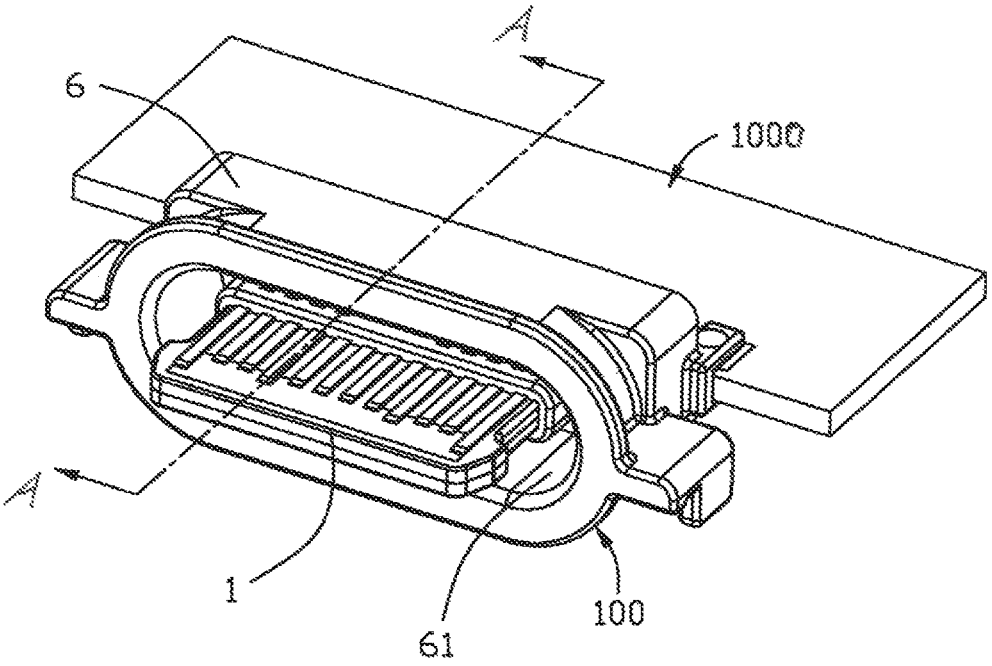
FIG. 1 is a perspective, assembled view of an electrical connector mated with a printed circuit board in a first embodiment.
Figure 2:
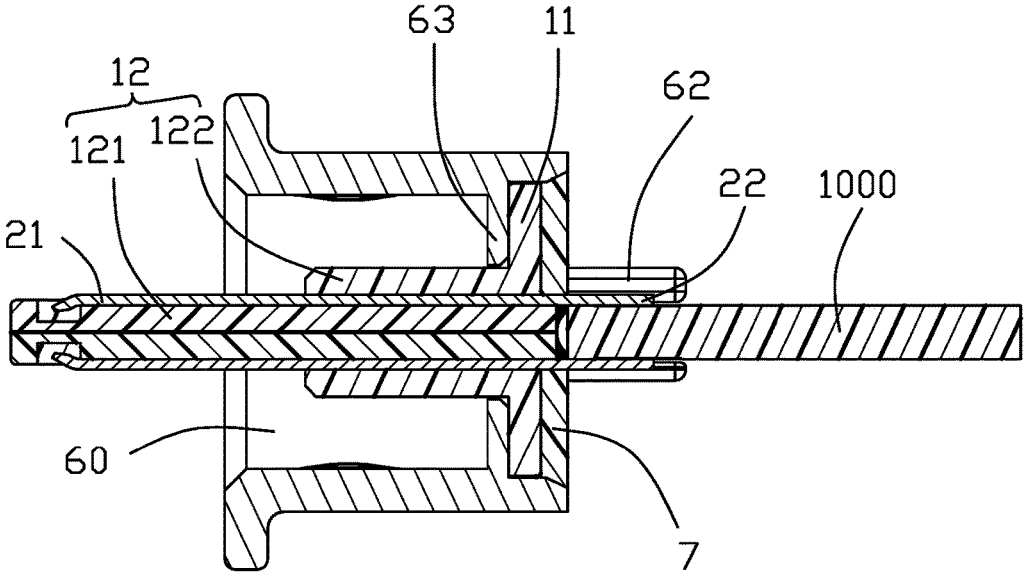
FIG. 2 is a cross-sectional view of the electrical connector mated with the printed circuit board taken along line A-A in FIG. 1.
Figure 3:
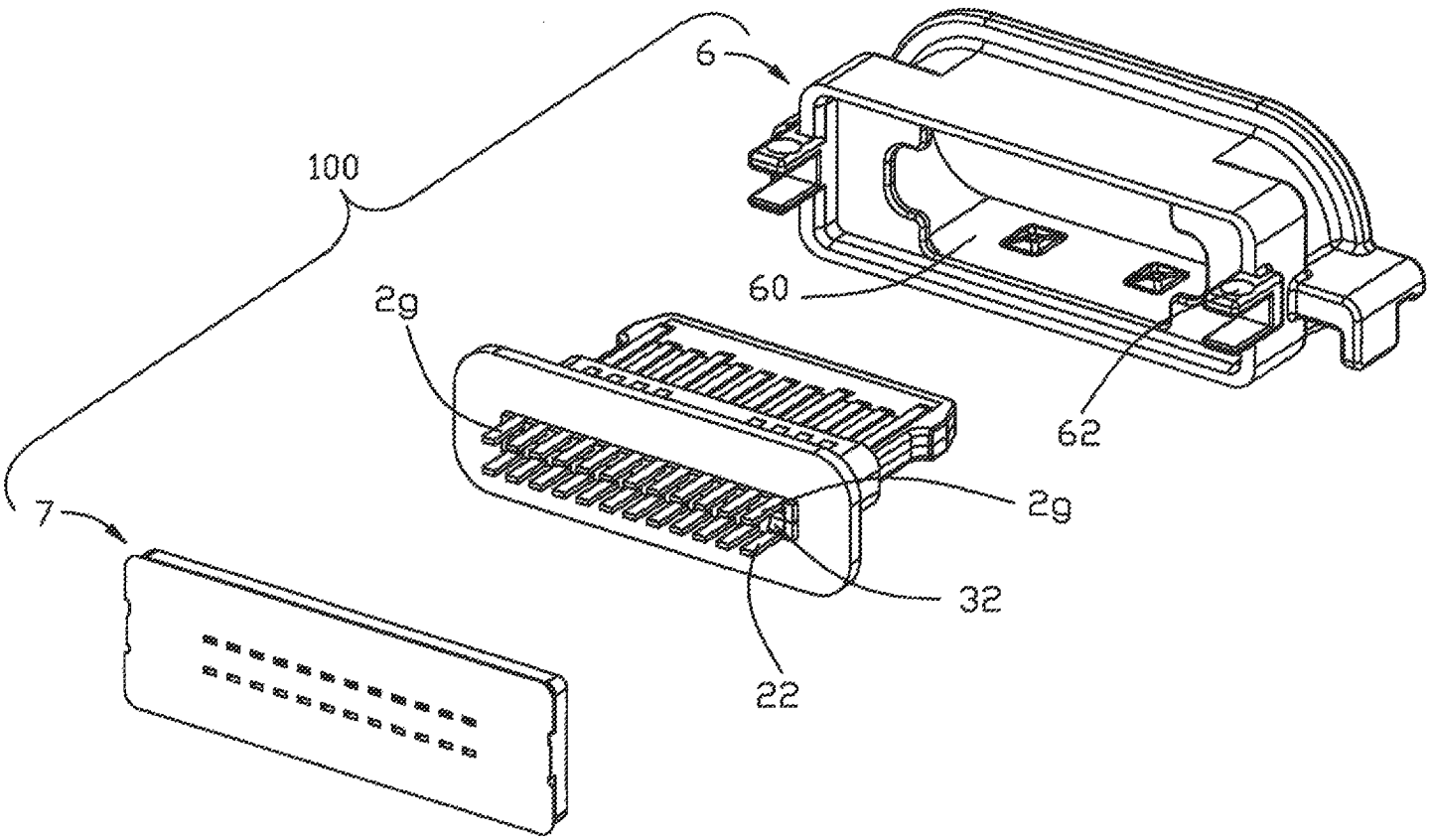
FIG. 3 is a partial exploded view of the electrical connector in the first embodiment.

Referring to FIGS. 1 to 3, the first embodiment discloses an electrical connector 100 mounted on a printed circuit board 1000. The electrical connector 100 includes a contact module 1, an outer shell 6 enclosing the contact module 1 and a sealer 7 sealing a rear end of the electrical connector.

Referring to FIGS. 1 to 6, the contact module 1 includes a base portion 11, a tongue portion 12 extending forwardly from the base portion 11 and a number of conductive terminals 2. The tongue portion 12 includes a front mating tongue 121 and a rear thickened portion 122. Each conductive terminal 2 includes a soldering portion 22 extending outwardly from the base portion 11 and a contacting portion 21 exposed to two surfaces of the front mating tongue 121.

In the first embodiment, the front mating tongue 121 is made of ceramic materials and the rear thickened portion 122 is made of insulative materials.

Referring to FIGS. 1 to 3, the outer shell 6 is a ring structure. The outer shell 6 includes a receiving room 60. The outer shell 6 is affixed to the base portion 11 and surrounds the tongue portion 12 to form a mating room 61 with the base portion 11 and the tongue portion 12. In the first embodiment, the conductive terminals 2 are arranged in two rows in a vertical direction. The soldering portions 22 extend rearward to solder on two surfaces of the printed circuit board 1000. The outer shell 6 includes a pair of soldering pins 62 parallel with the soldering portions 22. The printed circuit board 1000 is clapped between the soldering pins 62. The soldering pins 62 are soldered on the printed circuit board 1000. The outer shell 6 further includes a pair of barriers 63 protruding inwardly and resisting rearward against the base portion 11 preventing the contact module 1 moving forwardly. In the invention, the contact module 1 is assembled to the outer shell 6 along a rear-to-front direction. A free end of the barrier 63 resists against a rear end of the rear thickened portion 122. The waterproof materials are poured into the space between the rear edge of the outer shell 6 and the rear end surface of the base portion 11 to form the sealer 7.

Figure 4:
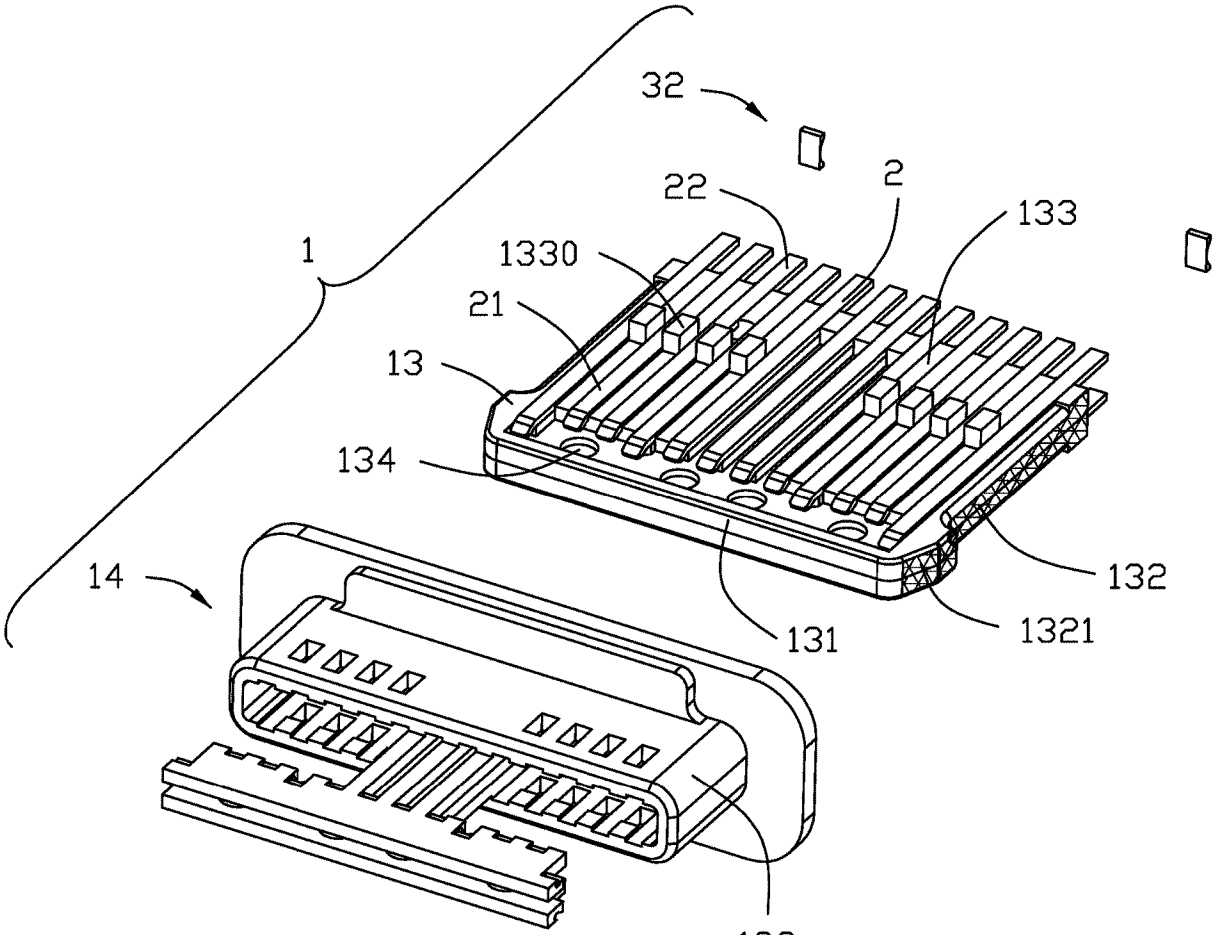
FIG. 4 is another partial exploded view of a ceramic flat portion, an insulator and a metal piece of the electrical connector in the first embodiment.
Figure 5:
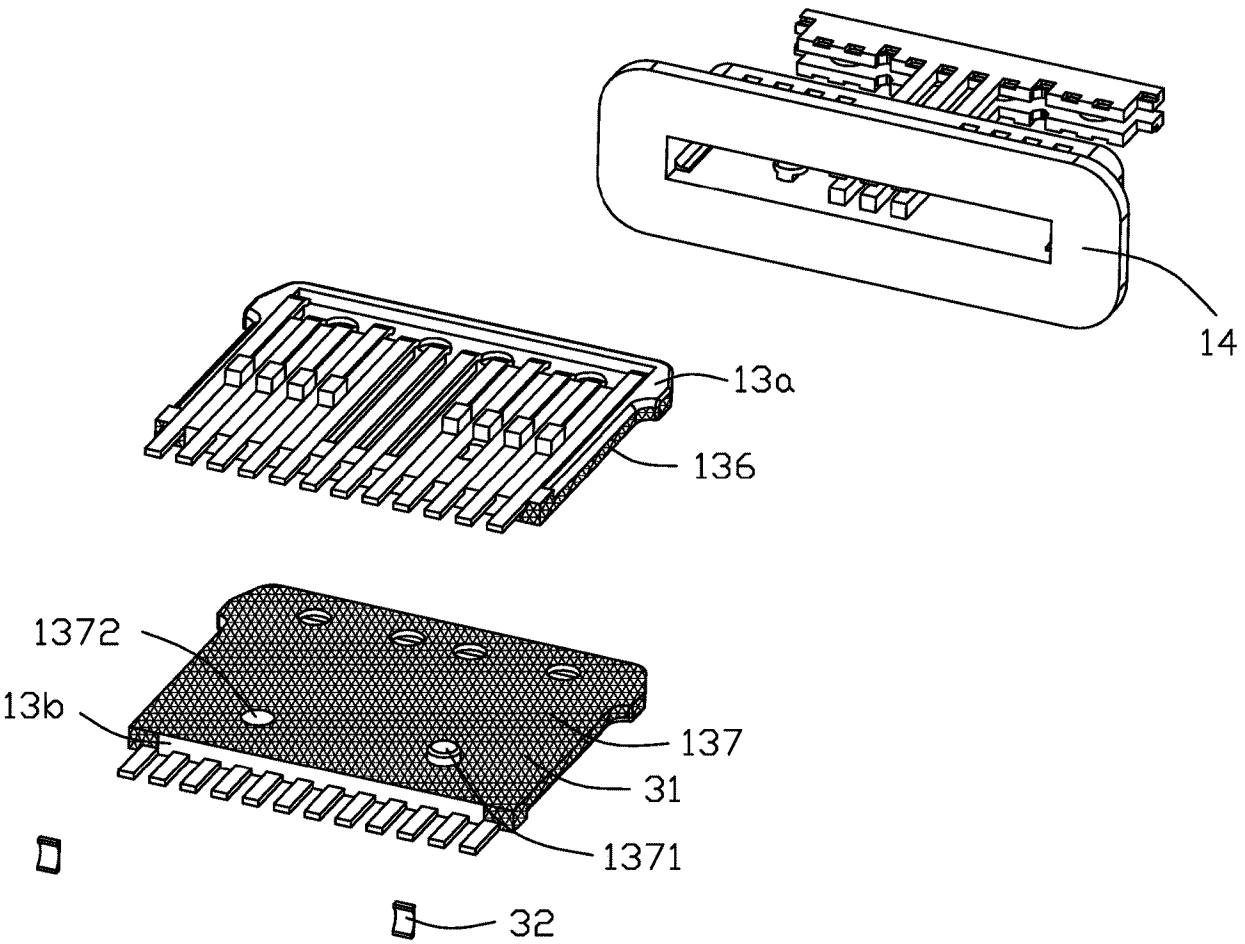
FIG. 5 is a partial exploded view of a contact module of the electrical connector in the first embodiment.
Figure 6:
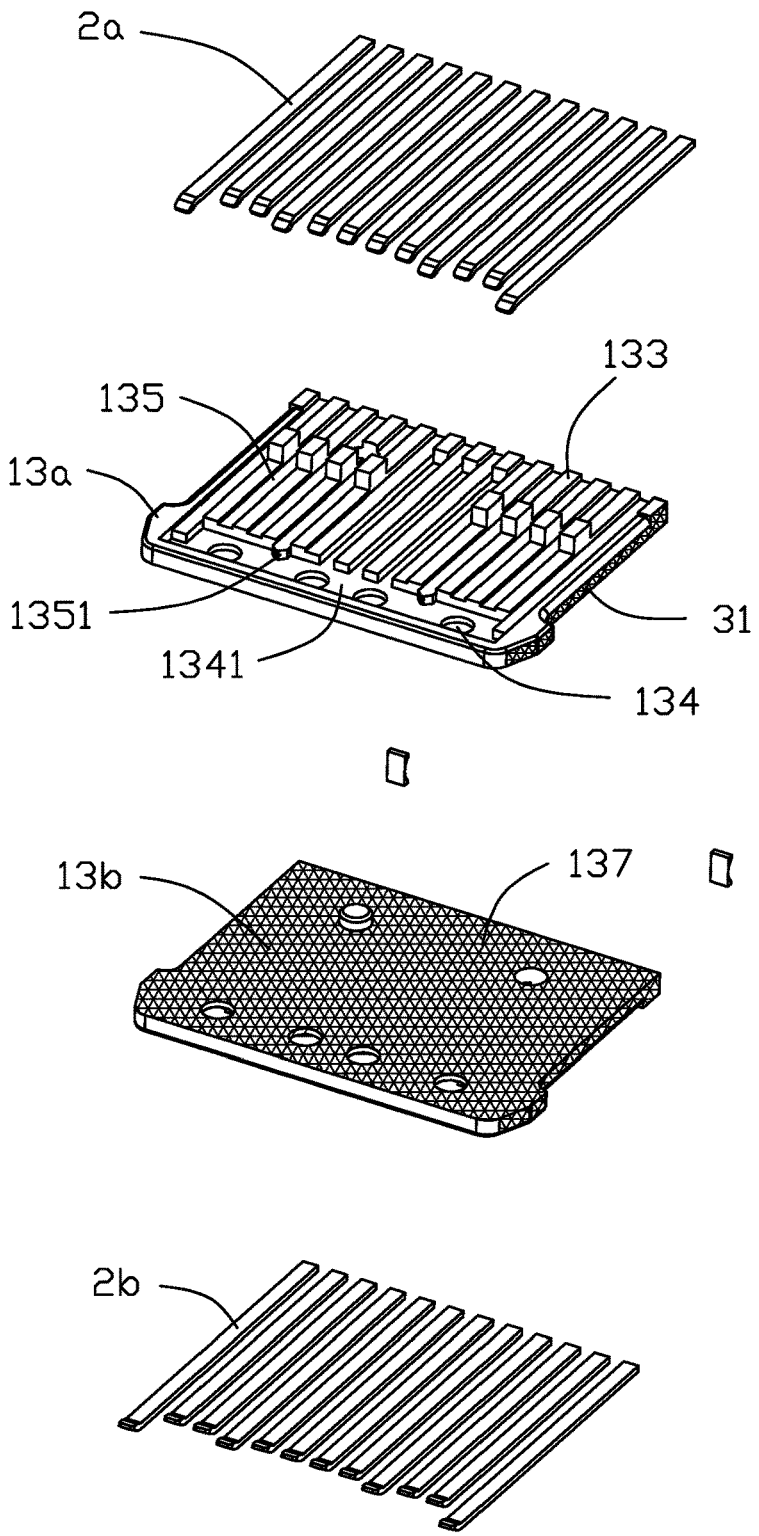
FIG. 6 is another exploded view of a first ceramic portion, a second ceramic portion, a number of conductive terminals and the metal piece of the electrical connector in the first embodiment.

Referring to FIGS. 4 to 6, the contact module 1 further includes a ceramic flat portion 13 made of ceramic materials and an insulator 14 made of insulative materials wherein the ceramic flat portion 13 and the insulator 14 commonly form the so-called supporting structure (unlabeled) of the contact module 1 for supporting the corresponding conductive terminals 2 therein. The conductive terminals 2 are disposed in two surfaces of the ceramic flat portion 13. The insulator 14 encloses the ceramic flat portion 13 and the conductive terminals 2 to form the base portion 11 and the rear thickened portion 122. The ceramic flat portion 13 is respectively provided on its opposite surfaces with surrounding walls 131, 132 surrounding its front edge and side edges. The surrounding walls 131,132 are higher than the middle portion thereof. The surrounding wall 132 includes a locking lateral wall 1321 protruding laterally. The ceramic flat portion 13 includes a number of first ribs 133 and second ribs 1330 arranged in a transverse direction perpendicular to the vertical direction and the rear-to-front direction and isolating from each other. The second ribs 1330 are formed by protruding upwardly from the first ribs 133 and located at a middle-to-rear portion. The conductive terminals 2 are linear, and are initially clamped between adjacent first ribs 133. The conductive terminals 2 are flush with the upper surface of the first ribs 133. When the insulator 14 is poured, the insulator 14 can ensure the retention with the ceramic flat portion 13 through the second rib 1330. The first rib 133 can ensure the insulator 14 provide reliable suppression to the conductive terminals 2. The soldering portions 22 extend outwardly from the ceramic flat portion 13. The ceramic flat portion 13 includes a number of through holes 134 penetrating a top surface and a bottom surface thereof and located at a rear end of the surrounding wall 131. The insulator 14 pours to form the rear thickened portion 122 and encloses a front edge of the ceramic flat portion 13 and the through holes 134. A front end of the contacting portion 21 bends forwardly and downwardly to be embedded in the insulator 14 preventing scratching a mated electrical connector. After the insulator 14 is injection molded, the two rows of conductive terminals 2 are flush with the surface of the ceramic flat portion 13, especially the surrounding walls 131,132 together to form the front mating tongue 121 of the tongue portion 12.

Referring to FIG. 5, the ceramic flat portion 13 includes a first ceramic portion 13*a* and a second ceramic portion 13*b* stacked with the first ceramic portion 13*a*. The first ceramic portion 13*a* and the second ceramic portion 13*b* respectively include a fixing portion 1371 and a fixing hole 1372. The first ceramic portion 13*a* and the second ceramic portion 13*b* both include an interior surface 137 coated with a metal layer 31. The metal layer 31 is coated or plated on the interior surface 137, but is not limited to the coating or plating arrangement. The ceramic flat portion 13 has no function about shielding signal interface. The metal layer 31 has function about shielding signal interface between two rows of conductive terminals 2. Referring to FIGS. 5 to 6, the first ceramic portion 13*a* and the second ceramic portion 13*b* both include a pair of lateral edges 136 and a rear surface both coated with the metal layer 31. Referring to FIG. 3, each row of conductive terminals 2 include a pair of ground terminals 2*g* located at outermost side. A metal piece 32 is arranged between the ground terminals 2*g* of two rows of conductive terminals in the vertical direction to realize a ground path. When the electrical connector 100 is mated with the mated electrical connector, the mated electrical connector connects with the lateral edges 136 to realize grounding. The metal layer 31 on the lateral edges 136 and the metal layer 31 on the rear surface connect with the metal piece 32. The metal piece 32 connects with the ground terminals 2*g*.

Referring to FIG. 6, the ceramic flat portion 13 includes a shallow terminal groove 135 located at a surface of the first ceramic portion 13*a* and the second ceramic portion 13*b* and disposed between the adjacent first ribs 133. The ceramic flat portion 13 further includes a transverse recess 1341 located at a front end. The through holes 134 are located at the transverse recess 1341. The insulator 14 pours into the transverse recess 1341 and includes a pair of power terminal grooves 1351 with its length longer than other terminal grooves. The ceramic flat portion 13 is made of ceramic materials, and when the conductive terminals 2 transmit a large current, the high temperature does not melt the ceramic, thereby protecting the product.

Referring to FIGS. 7 to 8, the second embodiment is shown. The difference between the first embodiment and the second embodiment is that the electrical connector 200 in the second embodiment has no metal piece. The rear surface of the ground terminal grooves 1352 and the rear surface of the first ceramic portion 13*a* and the second ceramic portion 13*b* are coated with the metal layer 31. The ground terminals 2*g* are received in the ground terminal grooves 1352, the grounding path is completed. The other structures of the electrical connector 100 in the second embodiment are same as that in the first embodiment.

Referring to FIGS. 9 to 11, the electrical connector 300 includes the outer shell, the sealer and the contact module as same as the electrical connector in the first embodiment except the ceramic flat portion 15. The ceramic flat portion 15 is one piece member and includes a number of first ribs 153 in the transverse direction located in a middle portion surrounded by the surrounding walls 151, 152. The middle portion is coated with the metal layer 31. The ceramic flat portion 15 includes a first surface 1211 and a second surface 1212 disposing with two rows of the conductive terminals 2. The metal layer 31 is at least coated with one of the first surface 1211 and the second surface 1212. The two rows of the conductive terminals 2 are molded with an insulative seat 4 isolating first row of conductive terminals 2*a* and the second row of conductive terminals 2*b* from the metal layer 31. The insulative seat 4 includes a connecting arm 42 and a number of insulative bars 41 parallel with each other. Each insulative bar 41 includes a front portion 411, a tail 412 parallel with the front portion 411 and a middle arm 413 connecting the adjacent insulative bars 41. The insulative bars 41 have a one-to-one correspondence with the conductive terminals 2.

Since the two rows of conductive terminals 2*a*, 2*b* are spaced by the metal layer 31, high frequency can be achieved against crosstalk. Moreover, since the ceramic flat portion 15 affixing with the conductive terminal 2 does not melt when the temperature is increased when the conductive terminal 2 transmits a large current, the product is protected.

Figure 13:
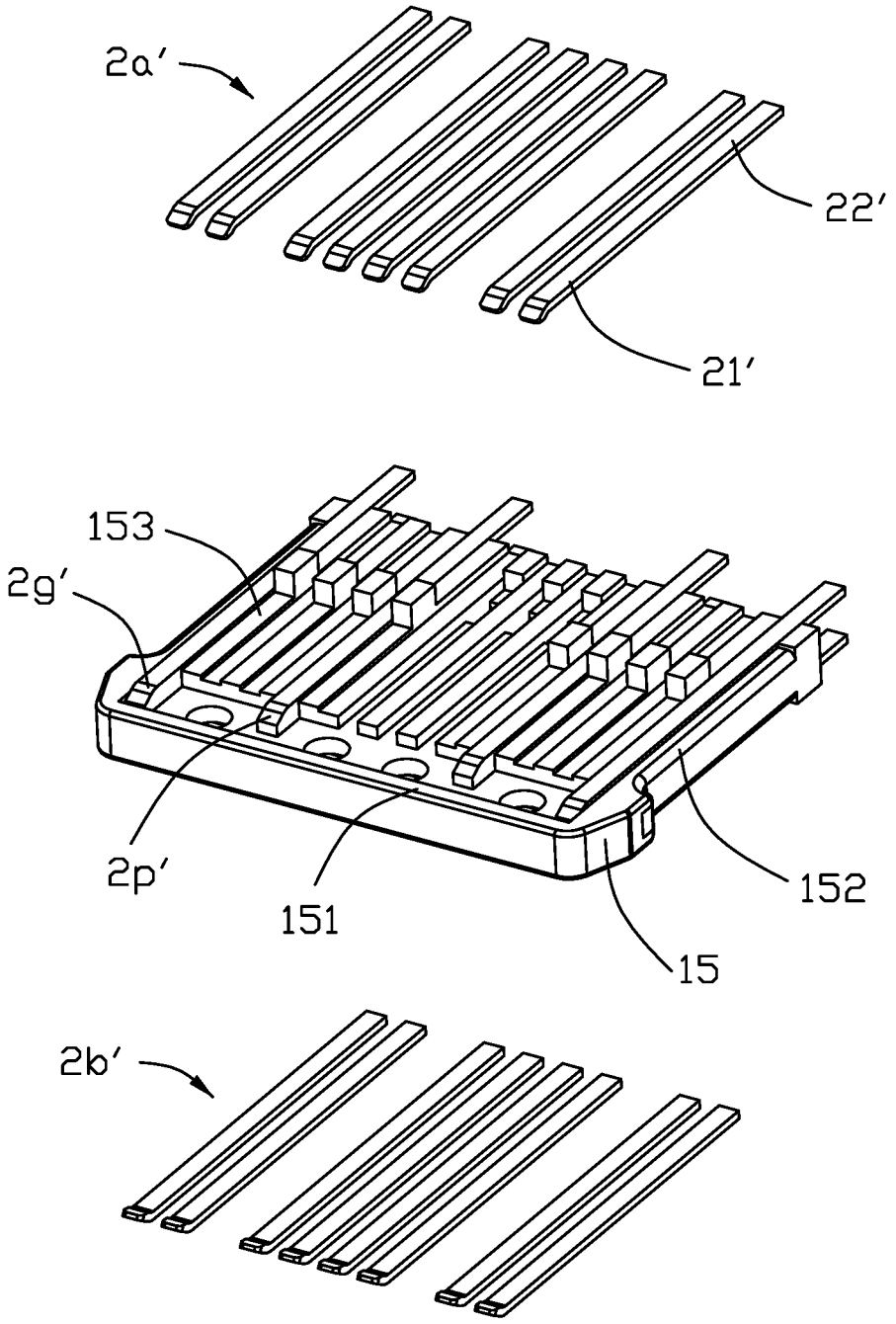
FIG. 13 is a partial exploded view of the contact module of the electrical connector in the fourth embodiment.
Figure 14:
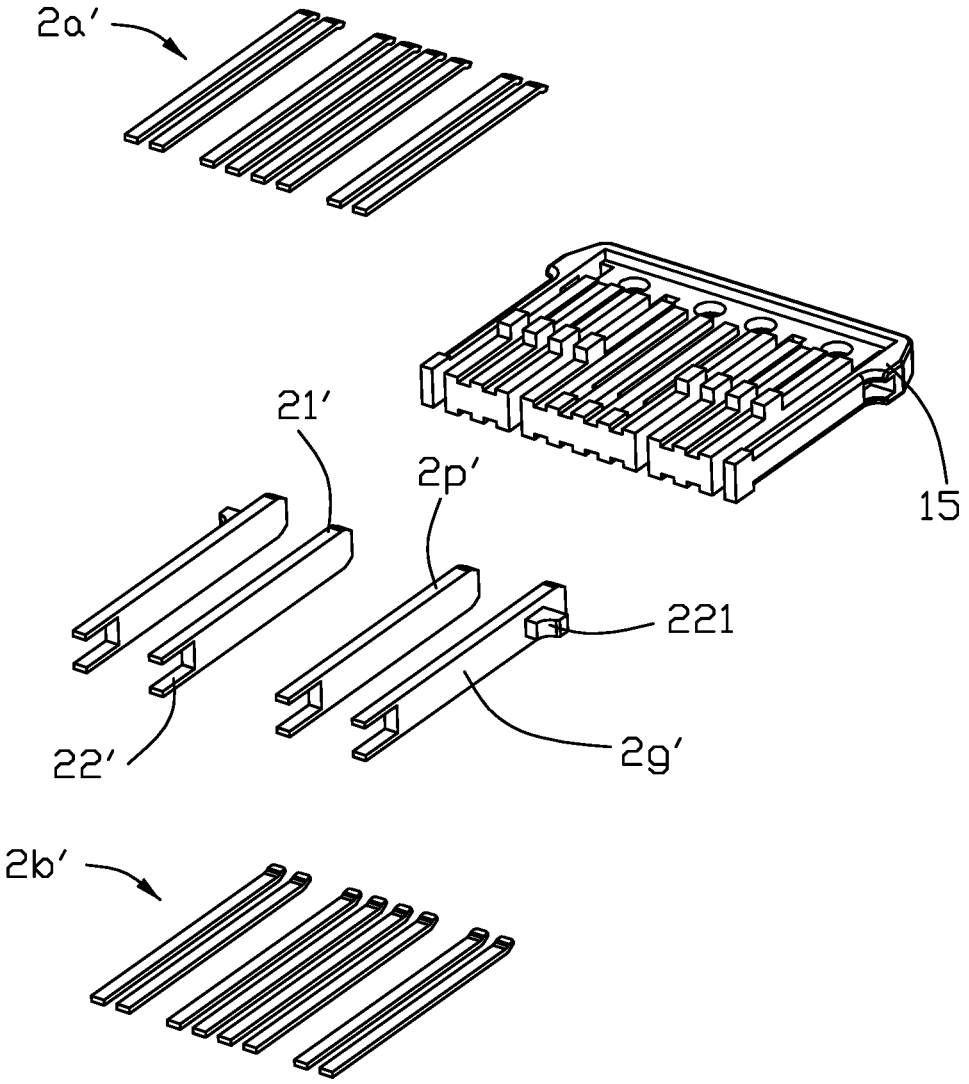
FIG. 14 is an exploded view of the ceramic flat portion and the conductive terminals of the electrical connector in the fourth embodiment.
Figure 15:
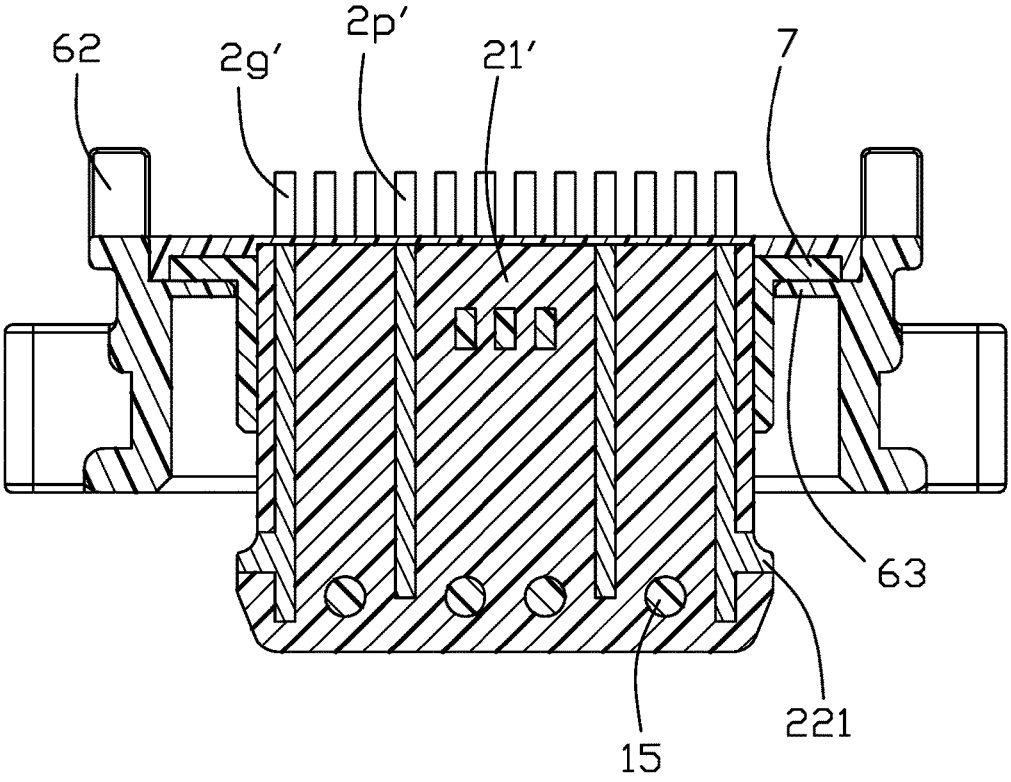
FIG. 15 is a cross-section view of the electrical connector in the fourth embodiment.

Referring to FIGS. 12 to 15, the outer shell, the sealer and the contact module in the fourth embodiment are as same as that in the third embodiment except the conductive terminals 2'. Referring to FIGS. 13 to 14, each row of conductive terminals 2*a*'/2*b*' include a pair of ground terminals 2*g*' located at outermost side, a pair of signal terminals and a pair of power terminals 2*p*' located inside of the ground terminals. The ground terminals 2*g*' and the power terminals 2*p*' are integrated with the ceramic flat portion 15. Since the sintering temperature of the ceramic material higher than that of the copper material, the ground terminals 2*g*' and the power terminals 2*p*' are copper powder molded on the ceramic flat portion 15. Each ground terminal 2*g*' includes a tuber 221 protruding two sides of the front mating tongue 121. The other signal terminals 2' are assembled to the ceramic flat portion 15, and the insulative materials are poured onto the conductive terminals 2' and the ceramic flat portion 15 to form the contact module 1. When the mated electrical connector (not shown) is in contact with the electrical connector 400, it is grounded by the tuber 221 in contact with the mated electrical connector. Further, at least one of the pair of ground terminals 2*g*' and the pair of power terminals 2*p*' of the two rows of conductive terminals 2*a*', 2*b*' are integrally connected to form a unitary body and integrally formed on the ceramic flat portion 15. The unitary body has a pair of soldering portions 22' spaced from each other in the vertical direction. Further, since the ceramic flat portion 15 does not melt when the temperature is increased when the conductive terminal 2' transmits a large current, the product is protected Compared with the prior art, in the four embodiments, the tongue portion affixing with the conductive terminals is made of ceramic materials, which can prevent the ceramic materials from melting and affect the performance of the product when the temperature is increased due to the transmission of a large current, and at the same time a metal layer is provided between two rows of the conductive terminals to shield the upper and lower terminals, and the high frequency performance of the product can be achieved.

While four preferred embodiments in accordance with the present disclosure have been shown and described, equivalent modifications and changes known to persons skilled in the art according to the spirit of the present disclosure are considered within the scope of the present disclosure as described in the appended claims.

What is claimed is:

1. An electrical connector comprising:

a contact module comprising a base portion, a tongue portion extending forwardly from the base portion, and two rows of conductive terminals, the tongue portion including a front mating portion and a rear thickened portion, each conductive terminal including a contacting portion exposed to two surfaces of the front mating portion and a soldering portion extending outwardly from the base portion; wherein the contact module is constructed of a ceramic flat portion and an insulator, the ceramic flat portion is coated with a metal layer, and the metal layer is located and shields signal interference between the two rows of conductive terminals.

2. The electrical connector as claimed in claim 1, wherein the conductive terminals are affixed to the ceramic flat portion, and the insulator is molded to the ceramic flat portion and the conductive terminals to form the base portion and the tongue portion.

3. The electrical connector as claimed in claim 2, wherein the ceramic flat portion comprises a row of through holes at a front edge thereof, and the insulator extends and covers the front edge and the through holes.

4. The electrical connector as claimed in claim 2, wherein there exists a row of ribs isolating from each other and located at a surface of the ceramic flat portion, and the conductive terminals are positioned between adjacent ribs.

5. The electrical connector as claimed in claim 1, wherein the ceramic flat portion comprises a first ceramic portion and a second ceramic portion mated with the first ceramic portion, each of the first ceramic portion and the second ceramic portion comprises a mating surface, and the metal layer is coated on at least one of the mating surfaces of the first ceramic portion and the second ceramic portion.

6. The electrical connector as claimed in claim 1, wherein the front mating tongue comprises a first surface and a second surface opposite to the first surface and disposing with the conductive terminals, and the metal layer is at least coated on one of the first surface and the second surface.

7. The electrical connector as claimed in claim 6, further comprising an insulative seat isolating the metal layer from the conductive terminals along a vertical direction.

8. The electrical connector as claimed in claim 7, wherein each row of conductive terminals comprise a pair of ground terminals located at two outermost sides, a pair of signal terminals, and a pair of power terminals located inwardly of the ground terminals, and at least the ground terminals or the power terminals of the two rows of conductive terminals are integrally connected to form a unitary body and are integrally formed on the ceramic flat portion.

9. The electrical connector as claimed in claim 1, wherein two lateral sides of the ceramic flat portion are coated with the metal layer, the two rows of conductive terminals comprise a pair of outermost ground terminals electrically connected to each other by a metal layer or a conductive member.

10. An electrical connector comprising:

a contact module defining, in a side view, a rear base portion and a front tongue portion forwardly extending from the base portion along a front-to-back direction, said tongue portion defining two opposite mating surfaces in a vertical direction perpendicular to said front-to-back direction, said contact module includes a supporting structure with a plurality of conductive terminals thereon, said conductive terminals being arranged in two rows each extending along a transverse direction perpendicular to both said front-to-back direction and said vertical direction, each of said conductive terminals having a front contacting portion and a rear soldering portion, the contacting portions of said two rows of conductive terminals being exposed upon the corresponding mating surfaces, respectively, and the soldering portions of said two rows of conductive terminals being exposed outside of the base portion; wherein said supporting structure includes a ceramic portion and an insulative plastic portion which is applied upon said ceramic portion via an insert-molding process and exposed upon at least one of said mating surfaces; and said ceramic portion includes two opposite parts stacked with each other in the vertical direction while said insulative plastic portion is of a unitary form.

11. The electrical connector as claimed in claim 10, wherein each of said two opposite parts is equipped with one corresponding row of said two rows of conductive terminals.

12. The electrical connector as claimed in claim 11, wherein each of said parts includes an interior surface coated with metallic layer for shielding and grounding.

13. The electrical connector as claimed in claim 12, wherein in each of said two opposite parts, each corresponding row of conductive terminals includes two opposite outermost grounding terminals mechanically and electrically connected to the corresponding metallic layer.

14. The electrical connector as claimed in claim 10, wherein said ceramic portion forms a plurality of spaced ribs located upon two opposite surfaces thereof in the vertical direction and embedded within the insulative plastic portion.

15. The electrical connector as claimed in claim 10, wherein a metallic layer is applied upon opposite lateral side edges of said ceramic portion.

16. An electrical connector comprising:

a contact module defining, in a side view, a rear base portion and a front tongue portion forwardly extending from the base portion along a front-to-back direction, said tongue portion defining two opposite mating surfaces in a vertical direction perpendicular to said front-to-back direction, said contact module includes a supporting structure with a plurality of conductive terminals thereon, said conductive terminals being arranged in two rows each extending along a transverse direction perpendicular to both said front-to-back direction and said vertical direction, each of said conductive terminals having a front contacting portion and a rear soldering portion, the contacting portions of said two rows of conductive terminals being exposed upon the corresponding mating surfaces, respectively, and the soldering portions of said two rows of conductive terminals being exposed outside of the base portion; wherein said supporting structure includes a ceramic portion and an insulative plastic portion which is applied upon said ceramic portion via an insert-molding process and exposed upon at least one of said mating surfaces; and each row of said two rows of conductive terminals is equipped with an insulative seat sandwiched between the row of said two rows of the conductive terminals and the ceramic portion in the vertical direction.

17. The electrical connector as claimed in claim 16, wherein a metallic layer is applied upon two opposite surfaces of the ceramic portion in said vertical direction, and said insulative seat isolates the corresponding conductive terminals from the metallic layer.

18. The electrical connector as claimed in claim 16, wherein said insulative seat includes a plurality of spaced ribs which are alternately arranged with a plurality of bars formed on the insulative seat along said transverse direction.

* * * * *